United States Patent [19]

Schuyler

[11] 3,959,790

[45] May 25, 1976

[54] APPLIANCE ALARM DEVICE

[75] Inventor: Daniel Schuyler, Sunnyvale, Calif.

[73] Assignee: Lawrence Peska Associates, Inc., New York, N.Y. ; a part interest

[22] Filed: Mar. 14, 1975

[21] Appl. No.: 558,263

[52] U.S. Cl. ..... 340/280; 340/282; 339/36; 200/50 A

[51] Int. Cl.[2] ..... G08B 21/00

[58] Field of Search ..... 340/280, 421, 282; 339/37, 36; 200/50 A, 50 AA, 50 B, 61.41, 61.59, 51.09

[56] References Cited

UNITED STATES PATENTS

| | | | |
|---|---|---|---|
| 2,916,733 | 12/1959 | Hirsch | 340/280 |
| 3,192,518 | 6/1965 | Sliman | 340/280 |
| 3,618,065 | 11/1971 | Trip | 340/280 |
| 3,781,857 | 12/1973 | Stenoig | 340/280 |

*Primary Examiner*—John W. Caldwell
*Assistant Examiner*—William M. Wannisky
*Attorney, Agent, or Firm*—Richard E. Nanfeldt

[57] ABSTRACT

An appliance alarm device communicates between a wall receptacle having at least two receptacles and the end plug of a cord of an appliance. The appliance alarm device includes a housing having a movable front wall. A pair of male connectors each having a pair of prongs extend through the rear wall of the housing, wherein the prongs are adapted to be received in the sockets of the wall receptacle. A female receptacle is mounted in the interior chamber of the housing and is aligned with a large circular hole in a sidewall of the housing. An indicator light is contained in the other sidewall of the housing. A switching member having a movable contact arm and an alarm member are contained in the housing. A first series circuit consists of the first male connector, the alarm member and the switching member. A second series circuit consists of the second male connector and the female receptacle. A movable plate is slidably contained on the inside surface of the one sidewall above the large circular opening, wherein the plate moves up and down across the opening in front of the female receptacle. A mechanism is provided for controlling the movement of the plate which communicates with the movable contact arm of the switching member.

5 Claims, 3 Drawing Figures

APPLIANCE ALARM DEVICE

SUMMARY OF THE INVENTION

My present invention relates to a unique and novel appliance alarm device communicating between a cord of an appliance and a wall receptacle having at least two sockets, wherein the alarm is activated, when the cord is disengaged from the device.

A number of U.S. Pat. No. 3,633,199; 3,696,378; and 3,765,008 have been employed as appliance theft protection alarm systems, but these aforementioned patents are non-applicable to my present invention.

An object of my present invention is to provide an appliance alarm device communicating between a wall receptacle and a cord of an appliance, wherein unauthorized removal of the cord from the device activates the detection device contained within the alarm device.

A further object of my device is to provide a means for preventing deactivation of the alarm device by reconnecting the cord to the alarm device after the cord has been initial disconnected.

A still further object of my present invention is to provide a means of locking the alarm device onto the wall receptacle.

Briefly, my present invention comprises a housing having a movable front all. A pair of male connectors each having a pair of prongs extend through the rear wall of the housing, wherein the prongs are adapted to be received in the sockets of the wall receptacle. A female receptacle is mounted in the interior chamber of the housing and is aligned with a large circular hole in a sidewall of the housing. An indicator light is contained in the other sidewall of the housing. A switching member having a movable contact arm and an alarm member are contained in the housing. A first series circuit consists of the first male connector, the alarm member and the switching member. A second series circuit consists of the second male connector and the female receptacle. A movable plate is slidably contained on the inside surface of the one sidewall above the large circular opening, wherein the plate moves up and down across the opening in front of the female receptacle. A mechanism is provided for controlling the movement of the plate which communicates with the movable contact arm of the switching member.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
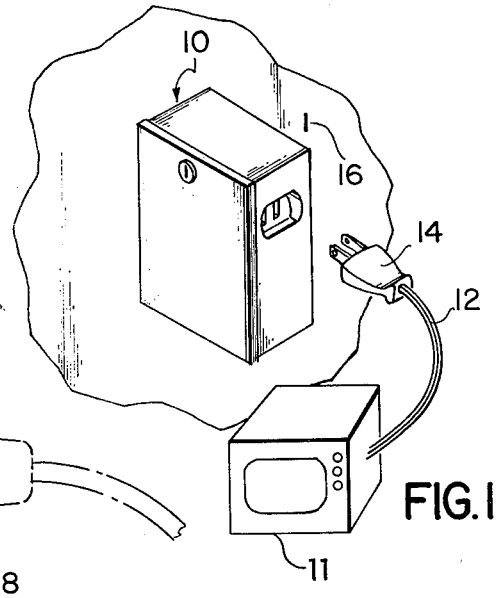
FIG. 1 illustrates a perspective view of an appliance alarm device.
Figure 3:
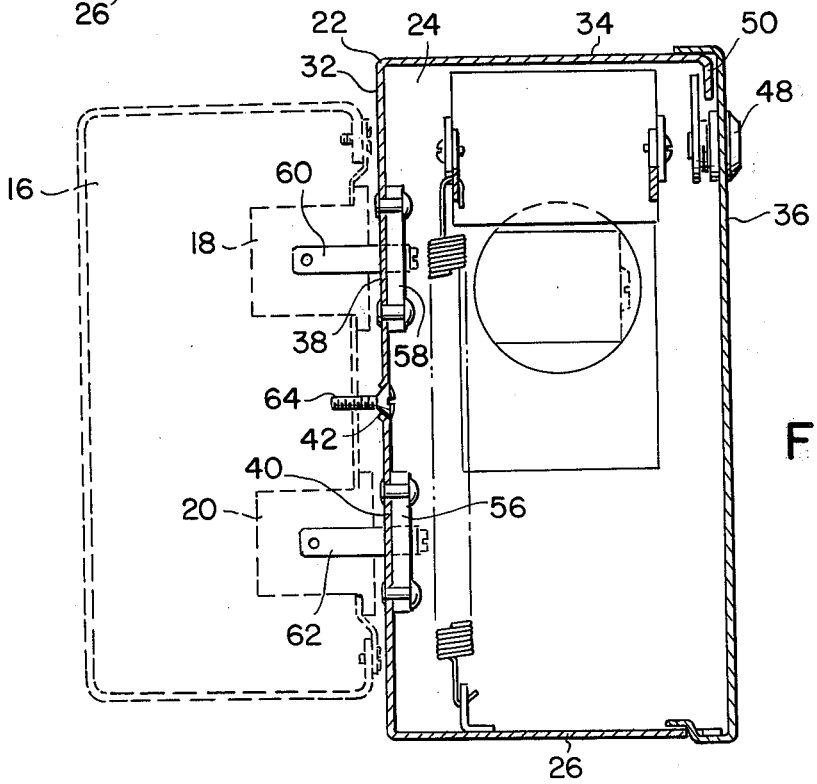
FIG. 3 illustrates a side cross sectional view of the appliance alarm device affixed onto a wall receptacle.

Turning now descriptively to the drawings, in which similar reference characters denote similar elements throughout the several views, FIGS. 1, 3 show an appliance alarm device 10 communicating between a cord assembly 12 of an appliance such as a television 11 having an end plug 14 and a wall receptacle 16 having at least two sockets, 18, 20 joined to a power source.

Figure 2:
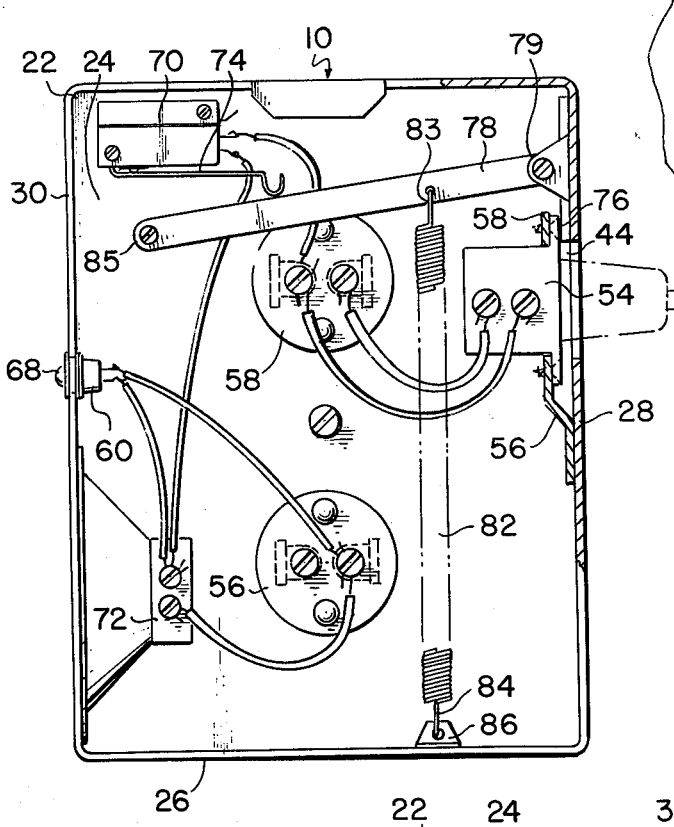
FIG. 2 illustrates a front cross sectional view of the appliance alarm device.

FIGS. 2, 3 show a more detailed view of the appliance alarm device 10 which comprises a rectangular shaped housing 22 having an interior chamber 24, a base 26, a pair of upwardly extending sidewalls 28, 30, a rear wall 32, a top 34, and a movable front wall 36 hingably communicating with a forward edge of base 26. The rear wall 32 has a pair of slot apertures 38, 40 therethrough and a central circular hole 42 therethrough. The front movable wall 36 has a circular aperture 46 therethrough. One sidewall 28 has a large circular opening 44 therethrough and the other sidewall 30 has a small opening 52 therethrough. A lock assembly 48 contained in front wall 36 communicates with a flange member 50 extending downwardly from the top 34. A female receptacle 54 is mounted onto flange members 56, 58 affixed to the inside face of sidewall 28, wherein receptacle 54 aligns, with opening 44 so that receptacle 54 is adapted to receive end plug 14. First 56 and second 58 male connectors each having a pair of outwardly extending prongs 60, 62 are mounted onto the inside of the rear wall 32 such that prongs 60, 62 extend through aperture 38, 40, wherein prongs 60, 62 are adapted to be received by sockets 18, 20. A means for securing the device 10 to the wall receptacle 16 comprises a mounting member 64 such as a screw extending through hole 42 and adapted to be received in the wall receptacle 16. A light socket 66 having an indicator light 68 therein is mounted into opening 52. An electrical switching member 70 having a movable contact arm 74 is contained in chamber 24. An alarm member 72 is contained in chamber 24. A first electrical series circuit consists of the first male connector 56, the alarm member 72 and the switching member 70, wherein the light socket 66 is wired in parallel across the first connector 56 and the alarm member 72. The second male connector 58 is wired directly to the female receptacle 54. A movable non-conductive plate 76 is slidably contained on the inside face of the sidewall 28 above opening 44, wherein plate 76 can slide up and down so as to open and close opening 44. A movable lever arm 78 is joined at one end 79 thereof to plate 76, wherein the other end 80 of arm 78 communicates mechanically with contact arm 74. A spring member 82 is mounted at one end 84 thereof to a mounting bracket 86 affixed to base 26 and at the other end 83 thereof to arm 78. The arrangement of lever arm 78 and spring member 82 is such that plate 76 is normally down across opening 44 and contact arm 74 of switching member 70 is closed upon the contact point 71 of member 70, wherein the first series circuit is energized. When end plug 14 is pulled out from receptacle 54, plate 76 moves down in front of receptacle 54 and across opening 44, thereby preventing reinsertion of the end plug 14 into the rceptacle 54. When plate 76 is down across opening 44, switching member 70 is closed, thereby permitting energization of the first series circuit and activation of alarm member 72. The device 10 is deactivated by opening the front wall 36 and moving the arm 78 such that plate 76 is moved upwardly. The end plug 14 is inserted into the receptacle 54, wherein the end plug 14 prevents the downward movement of plate 76. Alternatively, a lock element can be contained in housing 22, wherein lock element engages arm 78 as to move plate 76 up and down.

Since obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. An appliance alarm device communicating between a cord assembly of an appliance having an end plug and a wall receptacle having at least two sockets joined to a power source, which comprises:

a. a rectangular shaped housing having an interior chamber, a base, a pair of upward extending sidewalls, a rear wall, an upper end, a movable front wall hingably communicating with said base, said rear wall having two pairs of slot apertures therethrough and a central circular hole therethrough, one said sidewall having a large circular opening therethrough, and said front wall having a first circular aperture therethrough;

b. a lock assembly contained in said circular aperture and communicating with said upper end of said housing;

c. a female receptacle contained in said interior chamber, said female receptacle aligned with said large circular opening and adapted to receive said end plug;

d. a first and a second male connector each having a pair of outwardly extending prongs contained in said interior chamber, said prongs extending through said apertures and adapted to receive said socket;

e. means for securing said rear wall of said device to said wall receptacle;

f. a movable plate slidably contained on an inside face of one said sidewall above said large circular opening, said plate moving up and down across said large circular opening;

g. means for moving said plate;

h. an alarm member contained in said interior chamber;

i. an electrical switching member having a movable contact arm contained in said interior chamber;

j. means for mechanically interrelating said means for moving said plate and said contact arm;

k. a first series circuit of first said male connector, said alarm member, and said switching member; and l. a second series circuit of said female receptacle and second said mule connector.

2. A device according to claim 1, wherein a light socket adapted to receive an indicator light is wired in parallel across said alarm member and first said male connector.

3. A device according to claim 2, wherein said means for securing is a mounting member extending through said central circular hole, said mounting member adapted to be received in said wall receptacle.

4. A device according to claim 1, wherein said means for moving said plate comprises:

a. a movable lever arm affixed to said plate within said interior chamber; and b. a tension spring affixed to said movable lever arm, said tension spring applying a downward force to said lever arm for holding said plate down across said large circular opening in front of said female receptacle, when said end plug disengaged from said female receptacle.

5. A device according to claim 1, wherein said means for mechanically interrelating includes said lever arm engaging said contact arm of said switching member.

* * * * *